US005860493A

United States Patent [19]

Cherpitel

[11] Patent Number: 5,860,493

[45] Date of Patent: Jan. 19, 1999

[54] FALL PREVENTING MECHANISM FOR SAFETY LINES

[75] Inventor: Laurent Cherpitel, Cordon, France

[73] Assignee: SK SARL, Cordon, France

[21] Appl. No.: 805,059

[22] Filed: Feb. 24, 1997

[51] Int. Cl.[6] ..... A47L 3/04; B65H 59/16

[52] U.S. Cl. ..... 188/65.2; 188/65.1; 182/5; 182/193; 254/391

[58] Field of Search ..... 188/65.1–65.5; 182/5, 190–193; 254/391

[56] References Cited

U.S. PATENT DOCUMENTS

| | | | |
|---|---|---|---|
| 3,386,530 | 6/1968 | Thompson | 188/65.1 |
| 3,492,702 | 2/1970 | Stafford | 182/5 |
| 3,811,155 | 5/1974 | Stafford | 182/5 |
| 3,852,943 | 12/1974 | Healy | 182/5 |
| 4,542,884 | 9/1985 | Dodge | 188/65.1 |

*Primary Examiner*—Chris Schwartz

*Attorney, Agent, or Firm*—Fay, Sharpe, Beall, Fagan, Minnich & McKee

[57] ABSTRACT

A principal guide-plate (12*a*) is bent adjacent a first edge (13*a*) to define a retention groove (9) extending along an axis (y,y'). A secondary guide-plate (12*b*) is mounted parallel to the principal guide-plate with a first edge (13*b*) disposed parallel to and spaced from the principal guide plate first edge. A lever (16) is pivotally mounted (21) between the guide plates. The lever defines a cam surface (26) and a locking surface (25) for engaging a safety line (6) disposed in the retention groove. The lever has an aperture (23) at a second end for receiving a safety catch (5). The guide plates define a lower surface (17*a*, 17*b*) with a smaller radius (R1) and an upper surface (18*a*, 18*b*) with a larger radius (R2). A radial stop surface (20*a*, 20*b*) extends between the upper and lower arcuate surfaces to engage the safety-catch and prevent the lever from pivoting from a closed position (FIG. 10) in which the locking surface engages the safety line toward an intermediate position (FIG. 9) and an open position (FIG. 8) in which the safety line can be released from the mechanism.

8 Claims, 8 Drawing Sheets

FIG 1
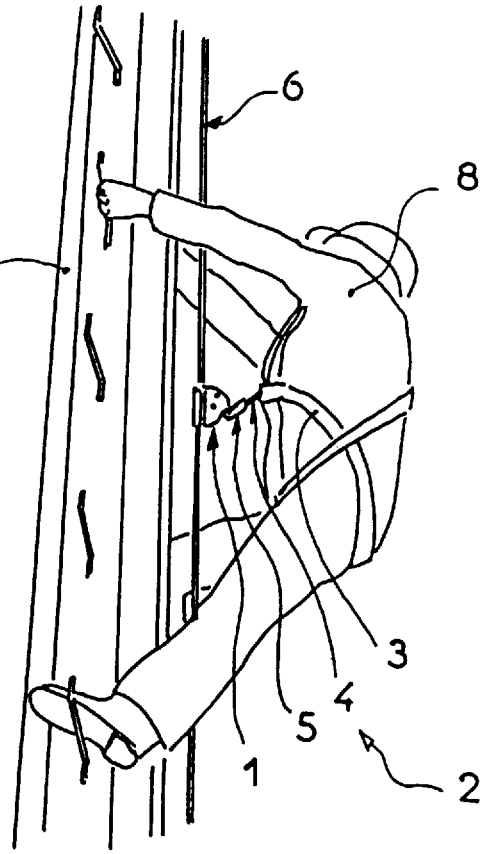
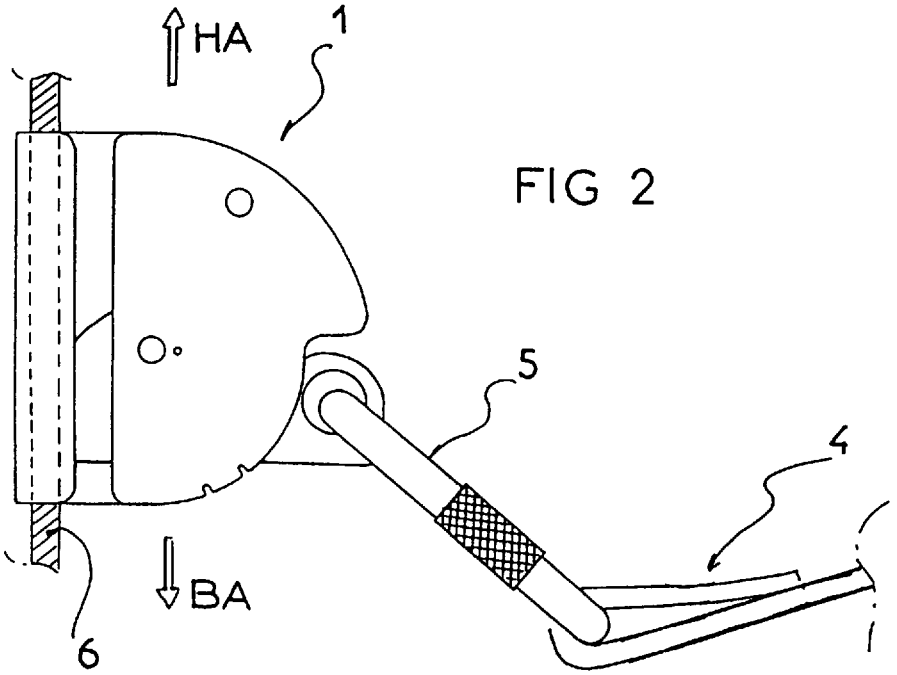
FIG 2

FALL PREVENTING MECHANISM FOR SAFETY LINES

BACKGROUND OF THE INVENTION

The present invention concerns an individual safety device for falls from an altitude. It relates to a movable fall-preventing device specifically adapted to vertical safety supports, notably flexible supports, such as cables or ropes.

Personnel, which has to intervene on high installations and who must, to that end, climb or descend the length of towers or poles, must have the assurance that they will not sustain untimely falls. This is, for example, the case with installers or repair personnel of installations such as cable cars or ski lifts. It is thus necessary to assure them that they can freely climb or descend with the risk of falling.

Such devices are already known, comprising a safety rope or safety cable, which is arranged vertically, also called "life line", upon which the user relies in order to move in upward or downward direction. To that effect, the user is fitted with individual safety equipment connecting the user to the "life line" and comprising a harness attached to a movable fall-prevention device. The known devices, however, are not totally satisfactory when it comes to convenience and reliability.

SUMMARY OF THE INVENTION

The present invention proposes are new device, the implementation of which is particularly safe, reliable and convenient.

Thus, according to the invention, the movable fall-prevention mechanism for safety lines, such as a cable or a rope, is of the type comprising a retention groove of an axis, in which said safety support is retained thanks to a cam, and it is characterized in that the inclined plane is an integral part of a lever pivoting between an open and a closed position, and whose free extremity comprises a hole, destined to receive a safety-clasp as well as a stop system so that the safety-clasp will limit the pivoting of the lever in an intermediary position when passing from a closed position toward an open position.

According to a preferred arrangement, the retention groove is realized by the wall of a main guide plate, while the fall-prevention mechanism comprises a secondary guide plate, constituted by a wall, with the lever being mounted pivoting between the two guide-plates.

According to an additional characteristic of the invention, a longitudinal and parallel passage to the axis of the groove is provided, said passage being laterally limited on the one side by the first edge of the principal guide plate and on the other side by the first edge of the second guide-plate.

According to another complementary characteristic, the two edges comprise a disengagement, permitting the displacement of the lever with its safety-hook and delimiting the ends, defining the intermediary position of the lever.

In a preferred exemplary embodiment, the second lateral edge of each of the guide-plates comprises a succession of two slopes, a lower slope in recess relative to an upper slope for forming the release. The lower slope is circular having a radius centered on the axis, while the upper slope is circular as well, with its radius centered on the axis,—given that the radius of said upper slope is higher relative to the radius of said lower slope, the release formed by the lower slope in recess is limited toward the top by the ends arranged radially and more or less in the horizontal plane, passing through the pivoting axis of the lever.

According to other complementary characteristics of the invention, the cam of the lever is constituted by a blocking slope, prolonged by an unblocking slope, while the width of the lever is such that it juts out beyond the upper slopes when the lever is in extreme open position.

Other characteristics and advantages of the invention are evident from the description below based on the attached drawings. These are provided by way of examples and are not limited thereto.

BRIEF DESCRIPTION OF THE DRAWINGS

FIG. 1 is a view of the entire unit, illustrating how the fall-prevention mechanism of the invention is utilized.

FIG. 2 is a lateral view, representing more specifically the fall-preventing mechanism mounted on the safety cable and its connection with the harness worn by the user.

FIG. 3 is a plane view, FIG. 4 is a lateral view of the side of the lever while FIG. 5 is a view from above.

FIG. 7*a* is an exploded perspective view, while

DETAILED DESCRIPTION OF THE PREFERRED EMBODIMENTS

Figure 4:
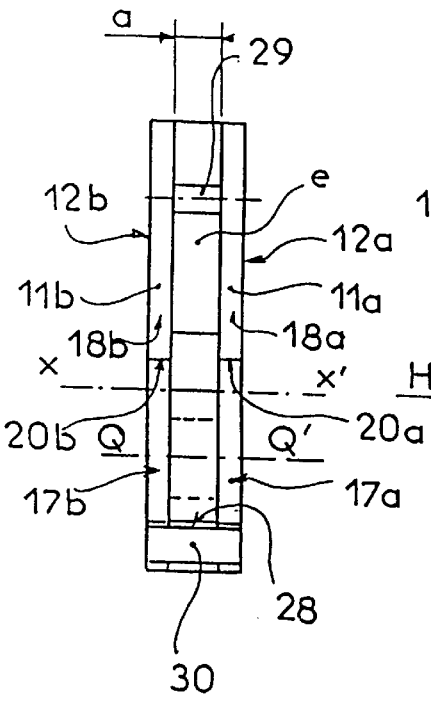
FIGS. 3, 4 and 5 are execution views of the fall-preventing mechanism.
Figure 3:
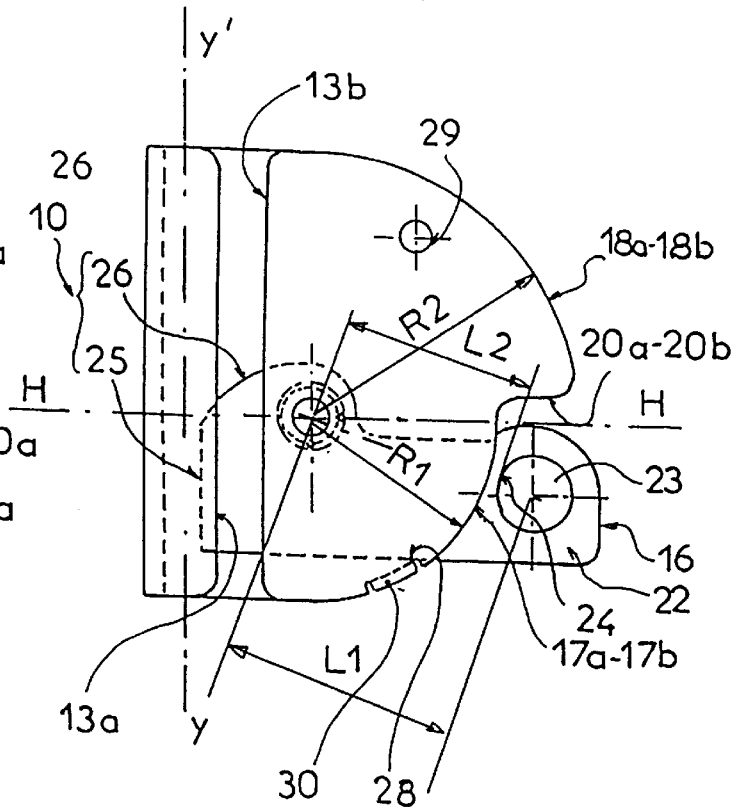
Figure 5:
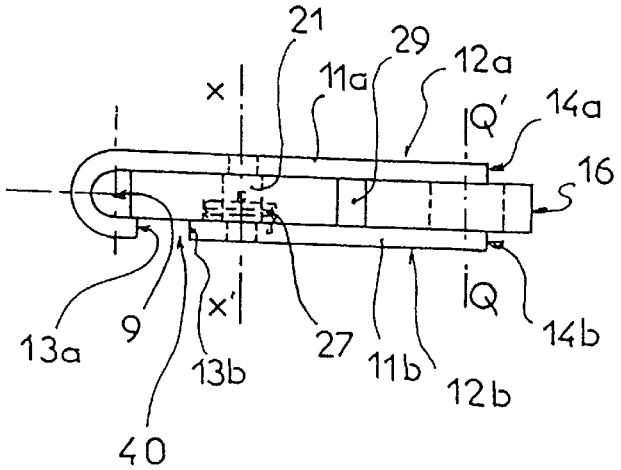

The movable fall-preventing mechanism (1) is part of individual protection equipment against falls from height, bearing the general reference number (2) and comprising in addition to said fall-preventing mechanism (1), a harness (3), having at least one fastening buckle (4) with a safety catch for hook-up (5), said fall-preventing mechanism (2) being destined to be connected in detachable fashion to a fixed vertical safety support (6), for example to an intervention tower (7).

In its utilization position, that is to say, connected to the harness (3) the movable fall-preventing mechanism (1) can be moved, at will, in upward direction (HA) or in downward direction (BA) by means of normal sliding (that is to say at the speed of ascent or descent of the user, along the length of the vertical cable (6) constituting the safety support, which can, furthermore, also be constituted by a rope. In the event of a fall, which corresponds to an accelerated rate of descent, the movable fall-preventing mechanism blocks itself on the cable. One comprehends that the user (8) can thus climb and descend the length of the tower (7) by letting the fall-preventing mechanism slide upward (HA) or downward (BA) along the length of the safety cable (6), when required, while he has the assurance that he will not fall downward as a result of the blockage of his fall-preventing mechanism (1) against said cable (6) constituting his safety support.

The fall-preventing mechanism (1) comprises, in essence, a recessed, rectilinear profile (9) destined to receive the safety cable (6) which is held in place after engagement thanks to a movable, pivoting cam (10). Thus, the recessed profile (9) is constituted by wall (11*a*) of a principal guide-plate (12*a*) whose first lateral edge (13*a*) is rolled up parallel to said wall in a manner so as to form a semi-circular gutter or groove (9), while the second lateral edge (14*a*) is in the plane of the wall and is curved to include at its lower portion a release (15*a*). It is noted that the groove has a semi-circular profile according to the vertical axis (YY') and has the approximate dimension of the cable destined to be arranged in it. Furthermore, the blocking cam (10) is an integral part of a handling and fastening lever (16) which is mounted movably, in pivoting motion on the fall-preventing mechanism around a transverse axis (XX').

It should be noted that the second lateral edge (14*a*) comprises a succession of two slopes, a lower slope (17*a*), which is recessed vis-a-vis an upper slope (18*a*) in order to form the release (15*a*). The lower slope is circular with radius (R1) centered on axis (XX') while the upper slope is circular with radius (R2) centered on axis (XX'),—given that radius (R2) of said upper slope is higher than radius (R1) of said lower slope. Moreover, the release (15*a*), whose function will be explained later on in the descriptive part, formed by the lower slope in recess, is limited toward the top by a stop (20*a*), arranged radially and approximately in the horizontal plane (H) passing through the pivot axis (XX') of lever (16).

The movable fall-preventing mechanism includes, furthermore, a principal guide-plate (12*a*), described earlier and forming groove (9) a secondary guide-plate (12*b*). The latter is integrally joined to the principal guide-plate so that it is parallel and spaced at a distance (d) to constitute, on the one hand, a space (e) between the two guide plates destined for movement of lever (16) and, on the other hand, a longitudinal passage (40) for engagement of the cable (40). The secondary guide-plate has an identical configuration as wall (11*a*) of the principal guide-plate (12*a*). Thus, it is constituted by a wall (11*b*) and comprises a first lateral, rectilinear edge (13*b*), while the second lateral edge (14*b*) is in the plane of the wall and is curved to include at its lower portion a release (15*b*). Thus, the second lateral edge (14*b*) comprises a succession of two slopes, a lower slope (11*b*) which is recessed relative to an upper slope (18*b*) in order to form the release (15*b*). The lower slope is circular, with radius (R1) centered on axis (XX') while the upper slope is circular, with radius (R2) centered on axis (XX'),—given that radius (R2) of said upper slope is above radius (R1) of said lower slope. Furthermore, the release (15*b*) whose function will be explained later in the descriptive portion, formed by the lower slope in recess, is limited toward the top by a stop (20*b*) arranged radially and approximately in the horizontal plane (H) passing through the pivot axis (XX') of lever (16). We are adding that passage (40) is limited laterally by the first edge (13*a*) of the principal guide-plate (12*a*) and the first edge (13*b*) of the secondary guide-plate (12*b*). It goes without saying that the width of the passage is greater than the diameter of cable (6) destined to be engaged with it, said passage extending parallel to axis (YY') of the groove.

The previously cited lever (16) is arranged in movable fashion, pivoting around axis (XX'). It is arranged to move between the two guide plates (12*a*, 12*b*) in a space (e) formed between the principal guide-plate (12*a*) and the secondary guide-plate (12*b*). It is thus mounted rotatably around an axis (21) extending between the two guide-plates so that its engagement extremity (22) extends beyond the lower slopes (17*a*, 17*b*) of the two guide-plates (12*a*), 12*b*) in the zone created by the releases (15*a*, 15*b*). Said non-engaged extremity (22) comprises in addition an attachment hole (23) destined to receive the safety catch (5) which can be engaged thanks to release (15*a*, 15*b*) provided on the edges of guide-plates (12*a*, 12*b*). The attachment hole (23) is cylindrical and its axis (QQ') is at a distance (L1) from axis (XX'), included in the value of the radius (R1) of the lower slope (17*a*, 17*b*) and the value of the radius (R2) of the upper slope (18*a*, 18*b*). In addition, its diameter is such that its peripheral wall (24) is at a distance (L2) from axis (XX') greater than radius (R2).

Figure 6:
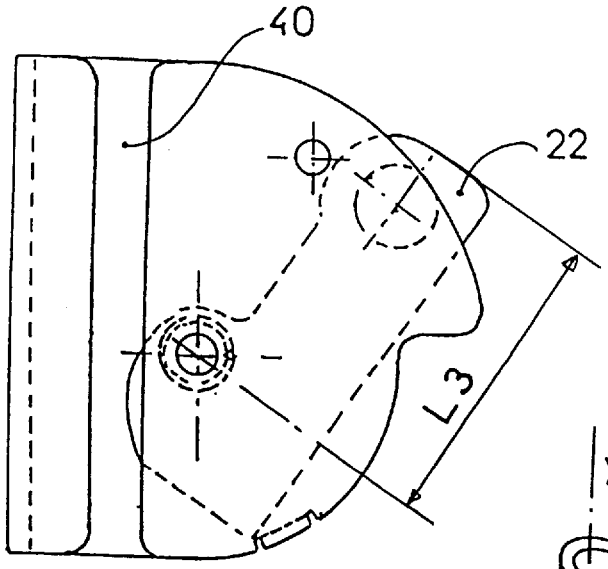
FIG. 6 is a view similar to FIG. 3., but illustrating the fall-preventing mechanism in its extreme open position, showing the various elements constituting the fall-preventing mechanism.
Figure 7A:
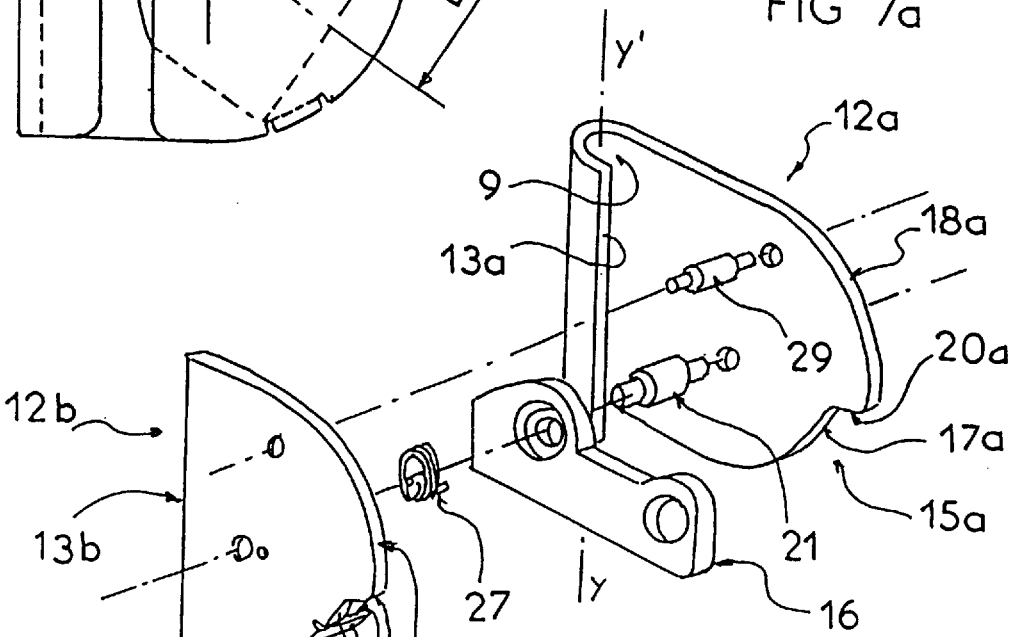
Figure 7B:
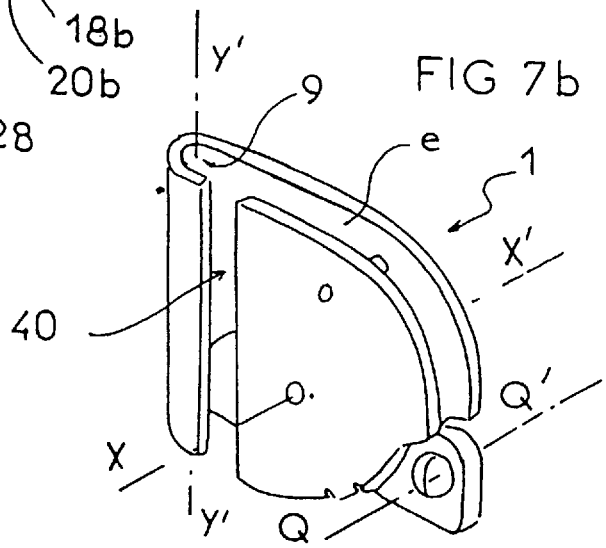
FIG. 7*b* is a perspective view of the mounted fall-preventing mechanism.

In addition, the lever (16) comprises on the side opposite the attachment hole (23) a cam (10) constituted by a stopping slope (25) to assure blockage of the fall-preventing mechanism (1) on the safety cable, extended by an unblocking slope (26) of the fall-preventing mechanism, permitting the sliding of said fall-preventing mechanism on said safety cable (6). The lever (16) can, through rotation around axis (XX') assume two extreme positions, an open position, as illustrated in FIGS. 6 and 8, and a closed position as represented in FIGS. 3, 10, 11 and 12.

It should be noted that the lever is constantly acted upon toward its closed position by a torsional spring (27). The latter is useful, on the one side, in keeping the fall-preventing mechanism (1) in place on the safety cable (6) at the moment it is put in place and for withdrawal of the safety catch (5), and, on the other side, in order to assure blockage of the fall-preventing mechanism in case of a fall, and that, even prior thereto, the safety catch has to guaranty, by itself, the pivoting of the lever in downward direction.

It is further indicated that the fall-preventing mechanism comprises two stops (28, 29) in order to limit the angular displacement of the lever downward by a lower stop (28) and upward by an upper stop (29). The lower stop (28) is realized by a small transverse wall (30) extending between the two guide-plates (12*a*, 12*b*) in the zone of the lower slopes (17*a*, 17*b*), while the upper stop (29) is realized by an upper cylindrical cross-piece, linking the upper position of the two guide-plates (12*a*, 12*b*).

Figure 8:
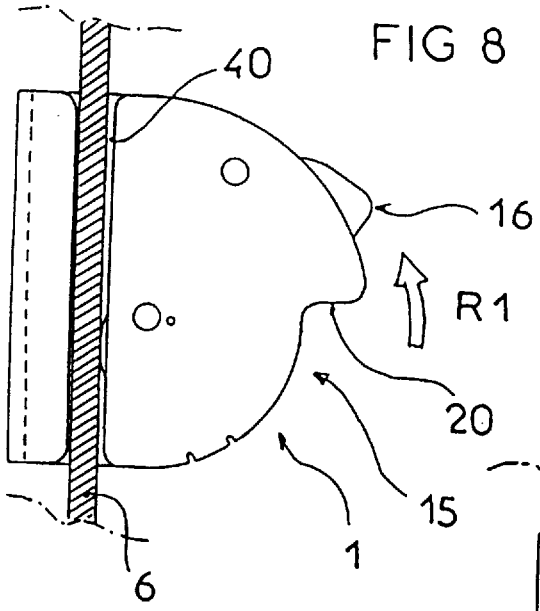
FIGS. 8 to 12 illustrate the different stages of putting into place the fall-preventing mechanism according to the invention.
Figure 9:
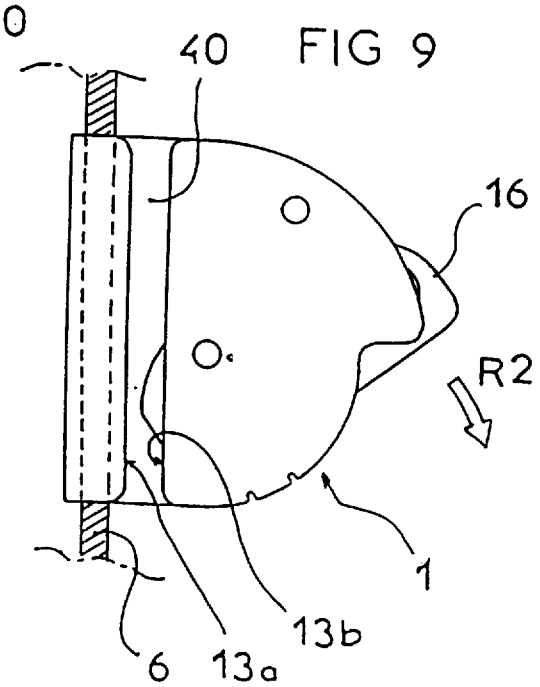
Figure 10:
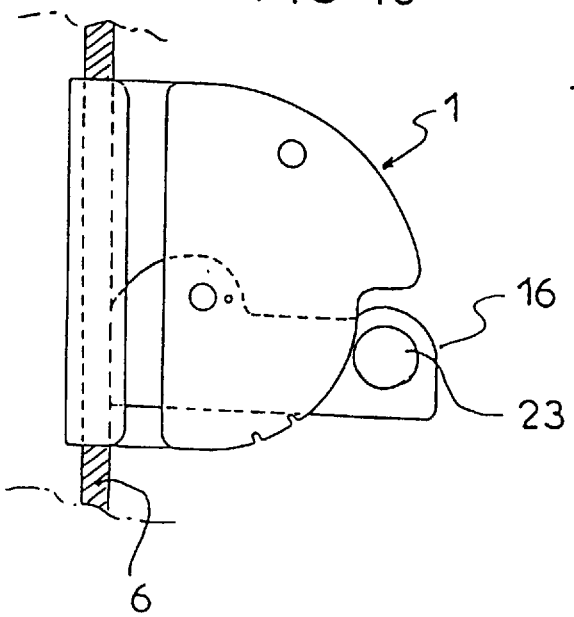

FIGS. 8 to 12 illustrate the different stages of putting into place the fall-preventing mechanism according to the invention. The user, while holding the first guide-plate (12*a*) of the fall-preventing mechanism (1) in the palm of his right hand, causes, with his thumb, the lever (16) to pivot in upward direction according to R1 in order to disengage the passage (40) for the cable. He introduces the fall-preventing mechanism (1) on the cable (6) to let said cable (6) pass via passage (40) as is illustrated in FIG. 8. Then he engages cable (6) in groove (9) and releases lever (16) as illustrated in FIG. 9. The lever (16), acted upon by spring (27), pivots in downward direction according to (R2) until the blocking slope (25) grips the cable, while retaining it thus in groove (9), as is represented in FIG. 10.

Figure 11:
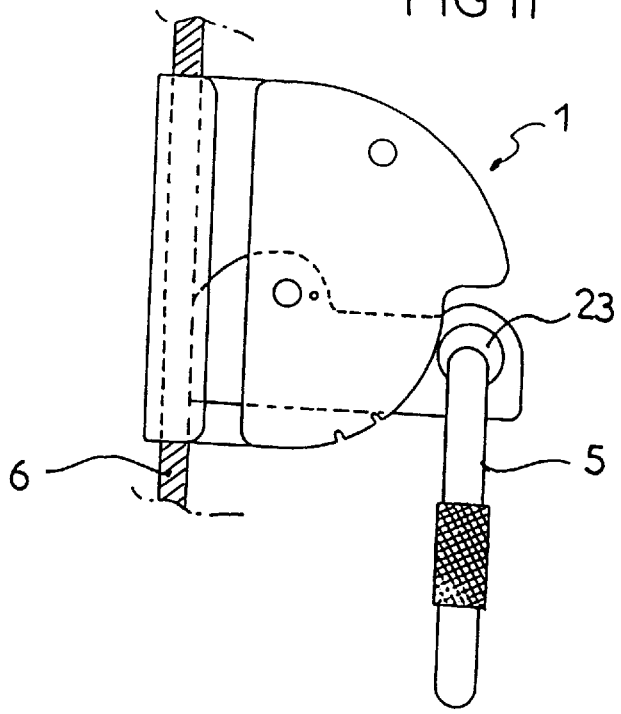

The user then installs a safety catch (5) and engages it in the hole (23) of the lever (16), as is illustrated in FIG. 11. He then attaches his harness (3) to the safety catch, for instance through intermediary of fastening buckles (4) as shown in FIG. 12.

Figure 12:
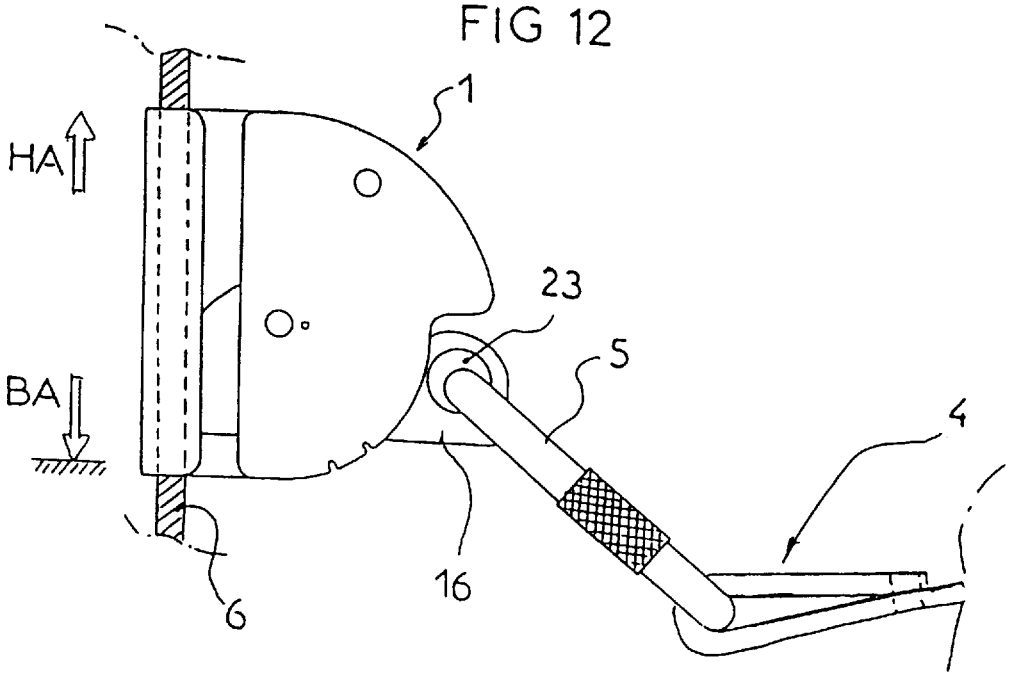
Figure 13:
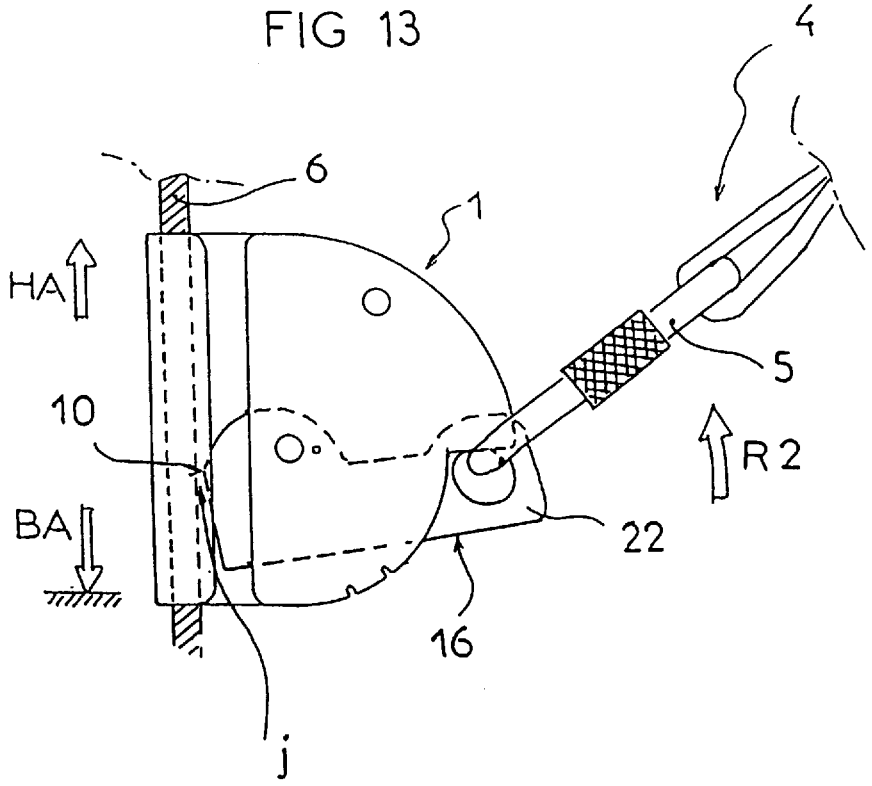
FIG. 13 represents how the fall-preventing mechanism according to the invention is utilized.
Figure 14:
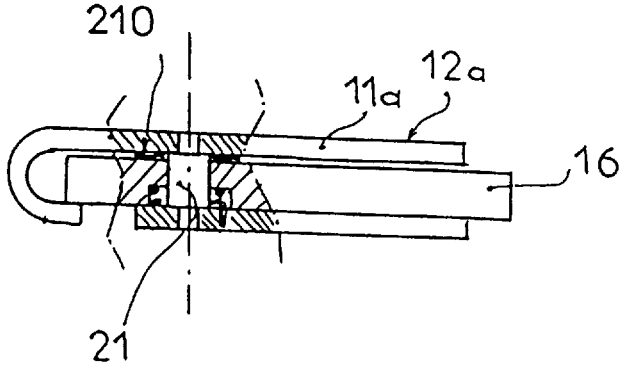
FIG. 14 is a view similar to FIG. 5, representing a variation of an embodiment with partial section according to the pivot axis of the lever.

In the position illustrated in FIG. 12, the fall-preventing mechanism (1) is blocked against any untimely descent downwards (BA), preventing a fall on the part of the user, but it can be moved in upward direction (HA) by rotation in upward direction according to (R1) of lever (16) as is illustrated in FIG. 13. While climbing, the user causes the lever (16) to pivot toward the top (HA) according to (R2) until the safety catch abuts against the stops (20*a*) and (20*b*) of the guide-plates. In that position, the lever precludes all possibility of the cable leaving the groove (9) and any slacking of the lever, which pivots again toward the bottom according to (R1) which causes blockage on the cable of the fall-preventing mechanism, While descending, the weight of the fall-preventing mechanism (1) and the spring permit the lever (16) to rest, abutting against stops (20*a*) and (20*b*) of guide-plates (12*a*) and (12*b*). Thus, the user is able to descend without involvement of the fall-preventing mechanism (1). In case of a fall or unnatural descend, the lever (16) pivots in downward direction (BA) according to (R1) while the blocking slope (25) is going to grip the cable (6).

According to the above description, it is apparent that the fall-preventing mechanism comprises a system of stops (20*a*, 20*b*) for the safety catch, a system of stops which limits the pivoting of the lever in an intermediary position when the user passes this lever from closed position toward open position. It is then impossible for the cable to leave the retention groove, with the cam (10) still being engaged in the retention zone of the cable, as is evident from FIG. 13. One also notes that the disengagement (15*a*, 15*b*) permits moving the safety catch (5) and thus the lever (16) from closed position up to the intermediary position, according to which the safety catch rests on the two stops (20*a*, 20*b*). In the intermediary position of FIG. 13, one notes that there is some play (j) between the cable and the cam (10) which permits free sliding toward the top (HA ) and toward the bottom (BA). However, in case of a fall, the fall-prevention mechanism (1) immediately returns to its blocking position as illustrated in FIG. 12.

In addition, the fall-preventing mechanism is beneficially made of metal such as, for example, stainless steel, We are adding, as is more specifically apparent from FIGS. 6 and 8, illustrating the fall-preventing mechanism in its extreme open position, that the length (L2) of the lever is such that its extremity (22) projects beyond the upper slopes (18*a*, 18*b*).

FIG. 4 represents an execution variation according to which the lever (16) does not rub against the wall (11*a*) of the first guide-plate (12*a*). To that end, a washer (210) is provided, which is arranged around the axis (21) between said lever (16) and wall (11*a*), as is apparent from the design in the sectional zone.

Figure 15:
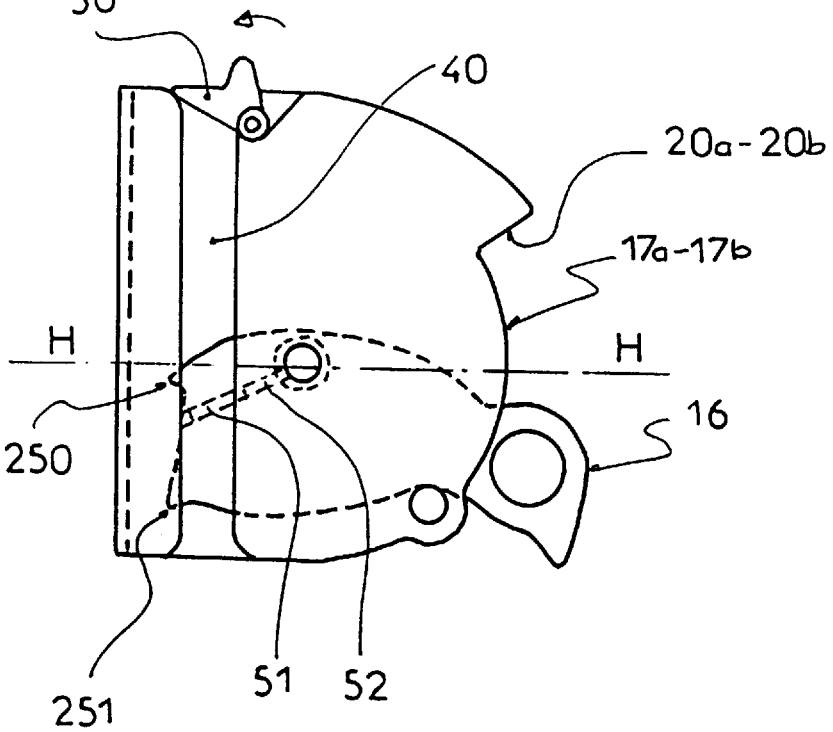
FIGS. 15, 16 and 17 illustrate a variation in execution, with FIGS. 15 and 16 being similar views to FIGS. 3 and 6.
Figure 16:
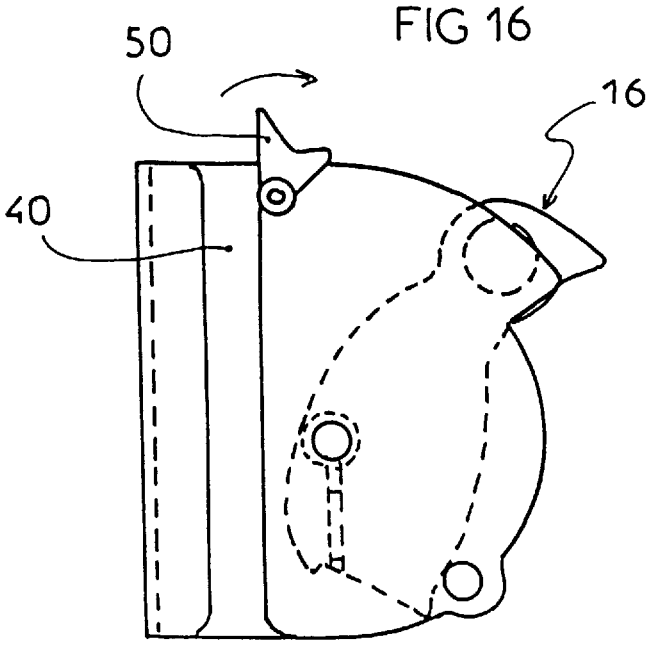

FIGS. 15 and 16 are views illustrating a variation of an embodiment according to which the blocking slope (25) comprises two blocking projections, that is to say, one upper projection (250) and one lower projection (251). In addition, according to said variation, the lower slope (17*a*, 17*b*) extends over a greater length than previously, going beyond and above the horizontal plane (H). It should also be noted that an additional safety organ is provided, constituted by a pivoting catch (40) which is induced to close by a spring. Said catch (50) is destined to lock up any untimely disengagement of the safety line (6) from passage (40).

Figure 17:
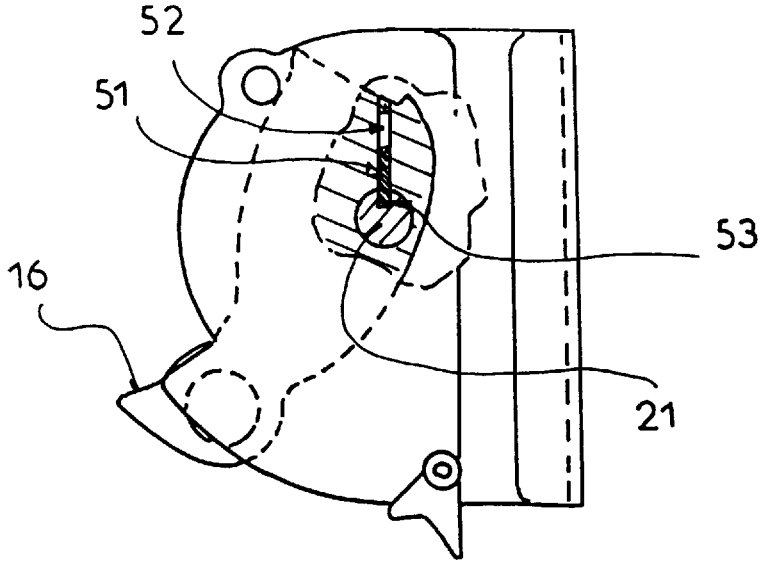

It should also be noted that in this variation additional locking means (51, 52, 53) are provided for the lever (16) of the kind that in completely reversed position of the device illustrated in FIG. 17, there is locking of said lever (16) in its extreme open position. To that end, a sliding "twig" (51) destined to slide freely in a hole (52) made in the lever, while in locked position the extremity of the "twig", on account of its own weight, engages with a corresponding hole (53) made in axis (21).

Needless to say, the invention is not limited to the embodiments described by way of examples, but it includes also all equivalent versions as well as their combinations.

I claim:

1. A movable fall-preventing mechanism comprising:

a guide assembly which defines a retention groove extending along a first axis;

a lever mounted to the guide assembly to pivot between an open position, an intermediate position, and a closed position, the lever including:

a cam for retaining a safety line in the retention groove, and a hole defined in a free extremity of the lever for receiving a safety-catch;

a stop system disposed on the guide assembly for engaging a safety catch to prevent the pivoting of the lever past the intermediate position when passing from the closed position toward the open position when a safety catch is received in the hole.

2. The fall-preventing mechanism according to claim 1, wherein the guide assembly includes a principal guide-plate and a secondary guide-plate, the lever being mounted between the principal guide-plate and the secondary guide-plate to pivot about a second axis.

3. The fall-preventing mechanism according to claim 2, further including a longitudinal passage defined parallel to the first axis of the retention groove, said longitudinal passage being laterally limited on one side by a first edge of the principal guide-plate and, on another side, by a first edge of the secondary guide-plate, the lever blocking movement of a safety line between the groove and the longitudinal passage in the intermediate and closed positions and permitting movement of a safety line between the groove and the longitudinal passage in the open position.

4. The fall-preventing mechanism according to claim 3, wherein a disengagement for permitting movement of the lever with a safety-catch attached between the closed and intermediate positions and the stop system is defined by second edges of the principal and secondary guide-plates.

5. The fall-preventing mechanism according to claim 4, wherein the second edge of each of the guide-plates comprises a succession of two slopes, a lower slope which is recessed relative to an upper slope to form the disengagement, the lower slope being circular with a first radius centered on the second axis and an upper slope which is circular with a second radius centered on the second axis, the second radius being larger than the first radius, the disengagement formed by the lower slope being limited toward its top by the stop system, the stop system including stop surfaces extending radially and approximately in the horizontal plane passing through the second axis.

6. The fall-preventing mechanism according to claim 1 wherein the cam is defined by a locking surface and an adjacent sloping release surface, the blocking surface engaging and locking the safety line when the lever is in the closed position and the sloping release surface slidably engaging a safety line when the release lever is in the intermediate position.

7. The fall-preventing mechanism according to claim 5 wherein the lever projects beyond the upper slope when the lever is in the open position.

8. A fall-preventing mechanism comprising:

a principal plate being curved adjacent a first edge to define a safety line retaining groove;

a secondary guide-plate disposed parallel to the principal guide-plate, the secondary guide-plate having a first edge disposed parallel to and displaced from the principal guide plate first edge such that a safety line receiving passage is defined therebetween;

a pivot extending between the principal and secondary guide plates;

a lever pivotally mounted on the pivot, the lever defining a cam surface adjacent a first end, which cam surface merges with a locking surface, the cam and locking surfaces being configured such that:

when the lever is in an open position, a safety line is free to pass through the safety line receiving passage into the retention groove, when the lever is in an intermediate position, the cam surface permits a safety line to slide through the retention groove and prevents a safety line from moving through the safety line receiving passage, and when the lever is pivoted to a closed position, the locking surface is adapted to engage a safety line and locks it against moving through the retention groove, the lever defining an aperture adjacent a second end thereof adapted to receive a safety-catch;

a stop surface defined by second edges of the principal and secondary guide plates, the stop surface being disposed adjacent to the aperture defined in the lever when the lever is in the intermediate position for engaging a safety-catch to prevent the lever from pivoting from the open position past the intermediate position toward the open position when a safety catch is received in the aperture.

* * * * *